United States Patent [19]

Groselak et al.

[11] 3,994,085

[45] Nov. 30, 1976

[54] BAGGAGE TAG

[76] Inventors: Robert E. Groselak, 901 S. Owen, Mount Prospect, Ill. 60056; Albert L. Podgor, 3625 N. Pontiac Ave., Chicago, Ill. 60634

[22] Filed: Mar. 29, 1976

[21] Appl. No.: 671,318

[52] U.S. Cl. ..... 40/21 R; 283/6

[51] Int. Cl.[2] ..... A44C 3/00; G09F 3/10

[58] Field of Search ..... 40/21 R, 20 R, 2 R, 40/10 R, 6; 283/6, 7, 20

[56] References Cited

UNITED STATES PATENTS

| | | | |
|---|---|---|---|
| 3,228,129 | 1/1966 | Gwinn et al. | 40/21 R |
| 3,231,992 | 2/1966 | Swett | 40/21 R |
| 3,593,443 | 7/1971 | Lansdale et al. | 40/2 R |
| 3,808,718 | 5/1974 | Christiansen | 40/21 R X |
| 3,917,276 | 11/1975 | Barg | 40/2 R X |

FOREIGN PATENTS OR APPLICATIONS

| | | | |
|---|---|---|---|
| 1,468,280 | 12/1966 | France | 40/21 R |

*Primary Examiner*—John F. Pitrelli

*Attorney, Agent, or Firm*—McWilliams & Mann

[57] ABSTRACT

A baggage tag assembly formed from a single continuous sheet of material including a portion printed for entry of passenger identification information. The assembly is constructed such that the identification portion, after being completed, is inserted through a handle of a piece of baggage and folded over and sealed between front and back cover portions such that the passenger identification information is concealed from sight. The tag assembly includes a detachable claim check. Printed on the exterior portions of the tag assembly are airline, flight and destination information and a passenger identification code.

7 Claims, 6 Drawing Figures

BAGGAGE TAG

BACKGROUND OF THE INVENTION

Recent airline industry regulations require that there be affixed to the outside of every piece of baggage, a tag or sticker indicating the name and address of the owner of the baggage. Compliance with such requirements has resulted in numerous problems. One example has been the observation of pieces of luggage at an airport by persons who may take advantage of the absence of a traveler from his home. For various other reasons travelers are hesitant to display their name and address readily visible for all to see on the outside of their luggage. Thus it as been desirable to devise a baggage identification tag which is easily attachable to a piece of baggage, which contains all of the required identification information and which provides for concealment of the identification information from unauthorized personnel.

SUMMARY OF THE INVENTION

The present invention comprises a baggage identification tag formed from a single continuous sheet of material. The tag includes an identifying claim number and a detachable claim check containing a matching claim number. The tag assembly includes front and back cover members, a connector portion and a passenger identification portion. The assembly is constructed such that the passenger or airline employee inserts the connector portion through the handle of a piece of baggage and folds over and seals the identification information portion between the interior surfaces of the cover members. The cover members are then sealed together over the information portion by means of adhesive applied to the interior surfaces of the cover members and one side of the information portion thereby concealing the passenger identification information from unauthorized personnel.

DESCRIPTION OF THE PREFERRED EMBODIMENT

Figure 1:
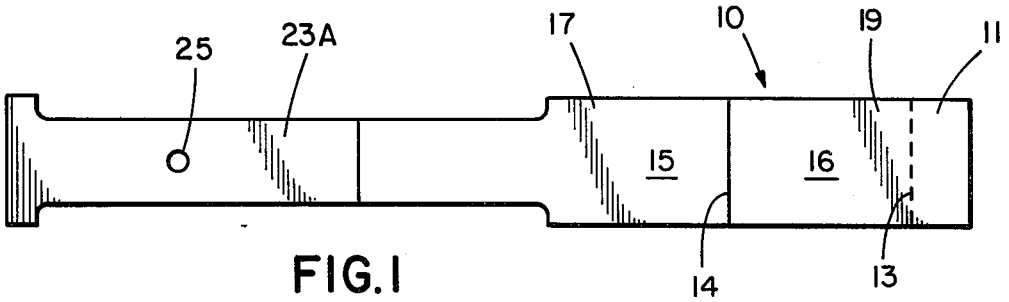
FIG. 1 is a front view of the interior surfaces of the baggage tag assembly in its unfolded condition.
Figure 2:
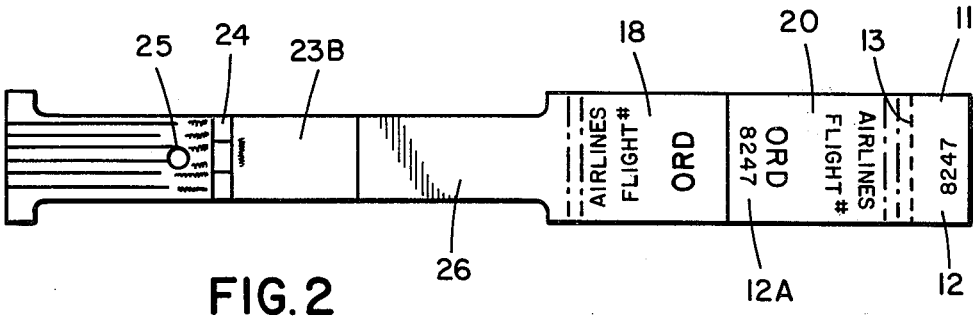
FIG. 2 is a rear view of the tag depicted in FIG. 1.

Referring now in more detail to the drawings, in which like numerals indicate like parts throughout the several views, FIG. 1 shows what will be referred to as the interior surface of a baggage tag assembly in its unfolded condition as cut from a single continuous sheet of material. The tag includes a first section 10 which is adapted to be attached to a piece of baggage and a second section 11 comprising a detachable claim check. As best shown in FIG. 2, the claim check 11 contains an identifying claim number 12. The claim check 11 is detachably connected to the first section by means of perforations 13.

The entire baggage tag assembly in the preferred embodiment is formed form TYVEK Spunbonded Olefin, a product of Du Pont. TYVEK Spunbonded Olefin is a family of tough durable sheet products of high-density polyethylene fibers formed by spinning continuous strands of very fine interconnected fibers and then bonding them together with heat and pressure. The resulting product provides a good printing surface, high opacity and toughness suitable for the tags of the present invention. It has been observed that tags made in accordance with the principles of the invention of TYVEK Spunbonded Olefin material can easily suspend a loaded suitcase weighing up to 75 pounds without tearing or ripping. These properties are essential in order to insure that the tag remains with the baggage even under the most severe handling conditions.

As best shown in FIGS. 1 and 2, the first section 10 consists of cover member 15 and a cover member 16. A score line 14 is provided between cover members 15 and 16 to facilitate bending or folding. The front cover member has an interior surface 17 and an exterior surface 18. The rear cover member 16 has an interior surface 19 and an exterior surface 20. Section 10 also includes a passenger identification portion 23 having an interior surface 23A and an exterior surface 23B. In the preferred embodiment interior surfaces 17, 19 and 23A have an adhesive coating applied over the entire surface. The adhesive used may be any of a number of commercially available adhesives but is preferably selected from the class of pressure sensitive adhesives which are readily sealable in the first instance upon application of pressure but are no longer sealable after the first seal becomes separated. One example of a pressure sensitive adhesive which performs the requisite functions in the present invention is Latex.

As shown in FIG. 2, the exterior surfaces 18 and 20 are imprinted with airline, destination and flight information. The surface 20 also includes an identical baggage claim number 12*a* which matches the claim number 12 on the detachable claim check portion 11.

The passenger identification information portion 23b is imprinted for entry of pertinent passenger identification information. This information includes the name, address and phone number of the baggage owner, along with the distination, address and phone number where the traveler can be reached during his stay. The passenger identification portion also includes a printed portion 24 for entry of a passenger identification code. An aperture 25 is defined within the passenger identification portion, the purpose for which will become apparent later.

The baggage tag also includes a connector portion 26 disposed between and connecting the cover member 15 and the passenger identification portion 23. As will be described, the connector portion 26 is adapted to be looped around the handle of a piece of baggage.

In operation, when the passenger arrives at the airport check in counter, either he or an airline employee will fill in the required passenger identification information in portion 23 of the baggage tag. The tag assemblies can be provided color coded, if desired, with airline and destination identification already imprinted on one of the exterior surfaces of the cover members. The flight number is then entered on the tag. When all of the required information has been completed, the detachable claim check 11 is removed from the tag assembly and is given to the baggage owner. One end of the tag assembly is then inserted through the handle 27 of the baggage to be checked. Next the passenger identification portion 23 is folded over the baggage handle 27 and bent around such that the passenger identification portion 23 overlies the interior surface 17 of the cover member 15. The cover member 16 is then folded along score line 14 so that the interior surface 19 overlies both the passenger information portion 23 and the interior surface 17. Pressure is then applied to seal the passenger information portion to both of the cover members 15 and 16 and to seal the cover members to each other. The adhesive on surface 17 bonds to the adhesive on surface 23A. The adhesive on surface 19 bonds lightly to surface 23B and at its outer edge bonds to the adhesive on surface 17.

Figure 3:
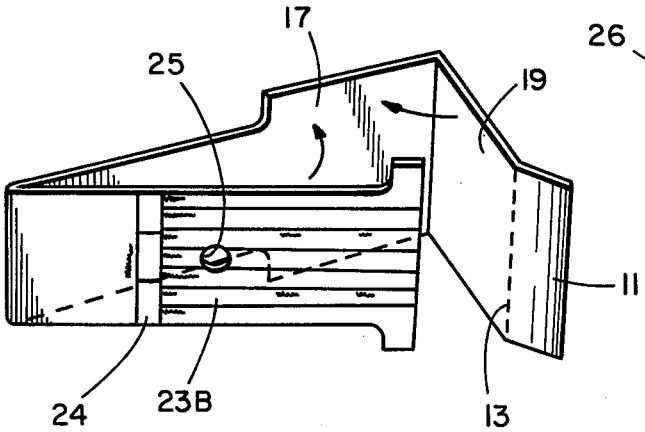
FIG. 3 is a perspective view showing the manner in which the baggage is to be folded.
Figure 4:
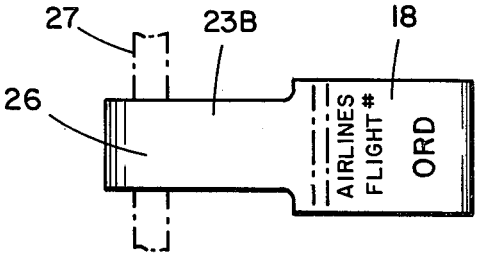
FIG. 4 is a rear view of the baggage tag in a folded and operative condition.
Figure 5:
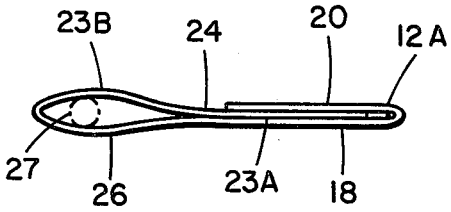
FIG. 5 is a top view of the tag depicted in FIG. 4.
Figure 6:
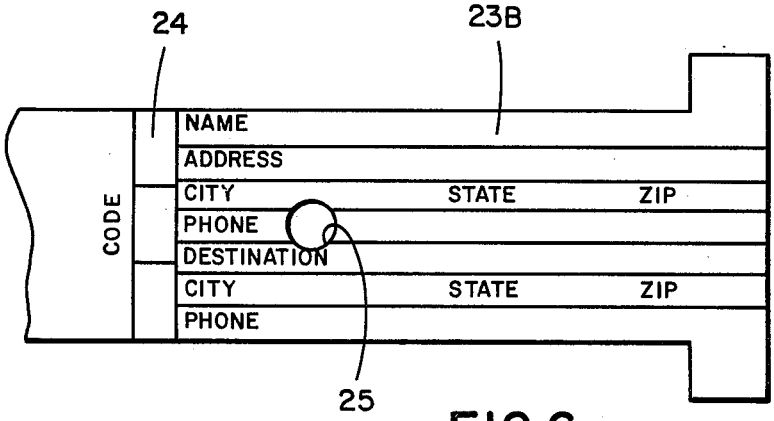
FIG. 6 is an enlarged view of a portion of the baggage tag.

As best shown in FIG. 3, when the tag assembly is in its folded and operative position the cover members conceal the passenger identification information from view by unauthorized persons. The code information section 24 is exposed to view and may be of assistance in identifying the traveler's baggage. The information inserted in the code secion 24 may consist merely of the baggage owner's initials. The claim check number 12A is readily visible and can be inspected by airline security personnel for comparison with the baggage claim check.

If, for any reason, a piece of baggage becomes misdirected, authorized airline personnel may sever the seal which holds together the cover member 15 and 16 by pulling cover member 16 away from cover member 15. The passenger information portion 23B is thus exposed while the interior surface 23A remains sealed to the interior surface 17 of the cover member 15 thus providing that the tag assembly remains attached to the baggage. An inspection of the passenger identification information will enable airline personnel to contact the baggage owner either at his home address or at his destination. Once the seal has been broken, because of the characteristics of the preferred adhesive, the seal cannnot be resealed. It will thus be apparent to the traveler upon inspection of the tag assembly that the tag has been tampered with.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A tag assembly formed from a single continuous sheet of material for identifying baggage, said assembly including a first section adapted to be attached to a piece of baggage containing a claim number; a second section detachably connected to said first section containing a matching claim number, said first section including front and back cover members each having interior and exterior surfaces, said cover members adapted to be folded along a line joining said cover members, said cover members containing adhesive on an interior surface thereof; a passenger identification portion printed to provide for entry of pertinent passenger identification information; a connector portion disposed intermediate and connecting one of said cover members and said passenger information portion, said connector portion adapted to be looped about a handle of an item of baggage, whereby said tag assembly is constructed such that when affixed to a piece of baggage said passenger information portion will be folded over and inserted between the interior faces of said front and back cover members and sealed therebetween such that said cover members will conceal said passenger identification information.

2. A tag assembly as in claim 1 in which said connector protion is printed for entry of a passenger identification code.

3. A tag assembly as in claim 1 in which one side of said passenger identification information portion is also coated with adhesive.

4. A tag assembly as in claim 1 wherein said adhesive is pressure sensitive.

5. A tag assembly as in claim 1 wherein said passenger identification portion includes an aperture defined therein to assist sealing of said cover members over said passenger identification portion.

6. A tag assembly as in claim 1 wherein portions of said exterior surfaces of said cover members are printed to contain airline destination and flight identification information.

7. A tag assembly as in claim 1 formed from a single continuous sheet of bonded plastic fibers.

* * * * *